US009441852B2

(12) United States Patent
Edgar et al.

(10) Patent No.: US 9,441,852 B2
(45) Date of Patent: Sep. 13, 2016

(54) PREFABRICATED, MODULAR, FIRE RESISTANCE AND NON-FIRE RESISTANCE RATED VENTILATION DUCT ASSEMBLY WITH INTEGRAL SUBDUCTS

(71) Applicant: HART & COOLEY, INC.

(72) Inventors: Glen A. Edgar, Lancaster, OH (US); Clark E. Pridemore, Grand Rapids, MI (US); Keith E. Page, Zeeland, MI (US)

(73) Assignee: HART & COOLEY, INC., Grand Rapids, MI (US)

( * ) Notice: Subject to any disclaimer, the term of this patent is extended or adjusted under 35 U.S.C. 154(b) by 105 days.

(21) Appl. No.: 14/483,067

(22) Filed: Sep. 10, 2014

(65) Prior Publication Data

US 2016/0069586 A1 Mar. 10, 2016

(51) Int. Cl.

| | |
|---|---|
| ***F16L 9/18*** | (2006.01) |
| ***F24C 3/00*** | (2006.01) |
| ***F24F 13/02*** | (2006.01) |

(52) U.S. Cl.

CPC ..... *F24F 13/02* (2013.01); *F24F 13/0245* (2013.01); *F24F 13/0263* (2013.01)

(58) Field of Classification Search

CPC ..... F24F 7/00; F24F 2007/002
USPC ..... 138/116, 177, 149, 148; 454/339, 184, 454/187

See application file for complete search history.

(56) References Cited

U.S. PATENT DOCUMENTS

| | | | | |
|---|---|---|---|---|
| 2,462,383 | A * | 2/1949 | Goodwin | B60H 1/00364 126/1 F |
| 3,222,777 | A * | 12/1965 | Rutter | F16L 59/10 138/147 |
| 3,870,615 | A * | 3/1975 | Wilson | C23F 13/02 204/196.18 |
| 4,412,479 | A * | 11/1983 | Ouwerkerk | F15D 1/001 138/39 |
| 6,073,658 | A * | 6/2000 | Bailey | F16L 9/08 138/155 |
| 8,267,759 | B2 | 9/2012 | McNulty et al. | |
| 2007/0042705 | A1 * | 2/2007 | McNulty | F24F 7/00 454/339 |

FOREIGN PATENT DOCUMENTS

DE 202013006423 U1 * 8/2013 ..... E04D 13/0643

OTHER PUBLICATIONS

Rohskopf, L., Drawing, Feb. 23, 2013.

* cited by examiner

*Primary Examiner* — Patrick F Brinson
(74) *Attorney, Agent, or Firm* — Jackson Walker LLP; Christopher J. Rourk

(57) ABSTRACT

A prefabricated, modular, duct assembly comprising a main duct having an outer wall, an inner wall, a first end and a second end. A horizontal duct assembly extending through the main duct between the first end and the second end. A vertical duct assembly extending along the inner wall from the horizontal duct assembly to the first end.

20 Claims, 8 Drawing Sheets

PREFABRICATED, MODULAR, FIRE RESISTANCE AND NON-FIRE RESISTANCE RATED VENTILATION DUCT ASSEMBLY WITH INTEGRAL SUBDUCTS

TECHNICAL FIELD

The present disclosure relates generally to heating, ventilation and air conditioning systems, and more specifically to a prefabricated, modular, ventilation duct system with integral subduct options to facilitate various appliance exhausting without the use of a fire damper. Such a prefabricate modular ventilation duct system may be of a fire resistance rated and/or non-fire resistance rated construction.

BACKGROUND OF THE INVENTION

Heating, ventilation and air conditioning (HVAC) systems use ducts that are generally field fabricated and installed in lengthy straight segments, and which are offered with a limited number of fittings, due to the difficulty of anticipating the configuration of HVAC systems. As such, the HVAC duct designs tend to be simple, such as tubular or rectangular runs.

SUMMARY OF THE INVENTION

A duct assembly comprising a main duct having an outer wall, an inner wall, a first end and a second end is disclosed. A horizontal duct assembly extends through the main duct between the first end and the second end. A vertical duct assembly extends along the inner wall from the horizontal duct assembly to the first end.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
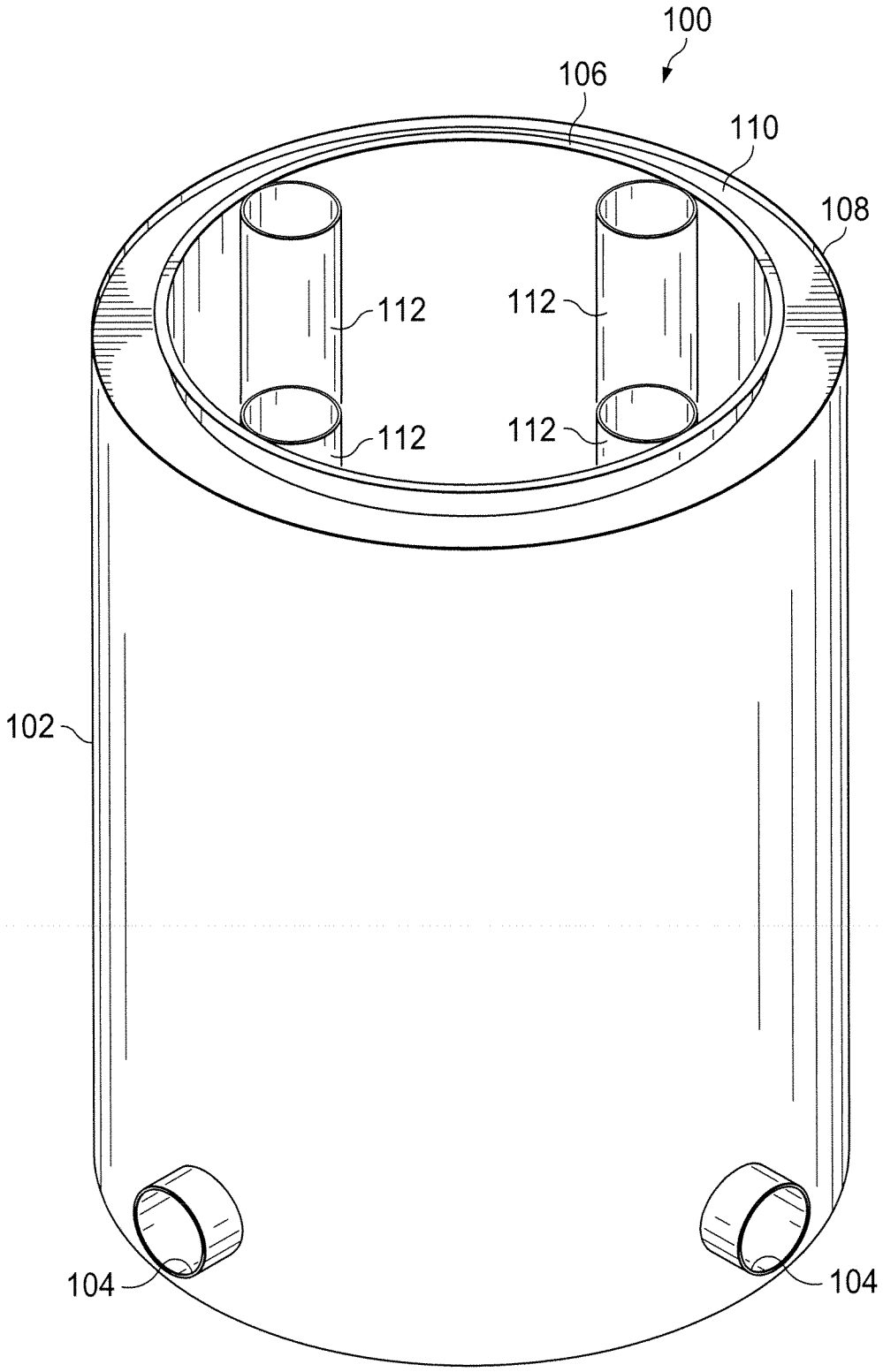
FIG. 1 is a diagram of a duct assembly with tubular subducts, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Up to three trades or sources are typically needed to make a shaft and ductwork with a subduct disposed inside, such as metalworkers, HVAC technicians and carpenters to build a fire-rated shaft (typically out of fire-rated sheet rock and metal studs) and to fabricate the ventilation main duct and internal subduct separately. By providing a prefabricated, modular, all-in-one, fire-rated ventilation shaft duct assembly with integral subducts, the need for time-consuming and expensive on-site fabrication can be avoided.

FIG. 1 is a diagram of a duct assembly 100 with tubular subducts, in accordance with an exemplary embodiment of the present disclosure. Duct assembly 100 includes horizontal tubular ducts 104, which are coupled to vertical tubular ducts 112. Vertical tubular ducts 112 are disposed within inner wall 106 of insulated main duct 102, with approximately 90 degrees of separation between each other. Although four horizontal tubular ducts 104 and vertical tubular ducts 112 are shown, other suitable numbers of horizontal tubular ducts 104 and vertical tubular ducts 112 could also or alternatively be used, such as one, two that are disposed at approximately 180 degrees from each other, two that are disposed at approximately 90 degrees from each other, three that are disposed at approximately 90 degrees from at least one other, or other suitable numbers and dispositions of ducts. In addition, the vertical ducts do not need to extend all the way to the end of the main duct, as shown, and can end at a point that is short of the end of the main duct.

Insulated main duct 102 is formed from outer wall 108, inner wall 106 and insulating material 110. Outer wall 108, inner wall 106, horizontal tubular ducts 104 and vertical tubular ducts 112 can each be formed from metal (such as steel, aluminum or other suitable metals), plastic (such as poly vinyl chloride, polyethylene or other suitable plastics), plastic-coated metal or other suitable materials, can be of uniform or dissimilar materials and construction, or can be fabricated in other suitable manners. Horizontal tubular ducts 104 can be installed within insulated main duct 102 by machining a penetration in insulated main duct 102 after it has been formed, by machining openings in outer wall 108 and inner wall 106 before they are assembled to form insulated main duct 102 and then by aligning the openings when outer wall 108 and inner wall 106 are formed, such as by bending sheet metal around a mandrel or in other suitable manners. Vertical tubular ducts 112 can be attached to inner wall 106 by welding, bonding, epoxy, bolts, rivets or in other suitable manners. Although the vertical tubular ducts 112 are shown extending to the top of the assembly, they can also be terminated at a lower position. Insulating material 110 can be injected into the space between outer wall 108 and inner wall 106, can be a sheet of insulating material that is wrapped around a mandrel after a sheet of metal that is used to form inner wall 106 is formed around the mandrel, or can be fabricated in other suitable manners. The amount of insulation required to comply with a fire rating can be selected as a function of the application, local regulations or in other suitable manners.

Although insulated main duct 102 is shown with horizontal tubular ducts 104, it can also be configured with only vertical tubular ducts 112, no subducts at all or any other suitable configuration of components, such as to form a modular section that can be connected to a lower section with horizontal tubular ducts 104 that are used to connect to an exhaust fan, a clothes dryer exhaust, a warm air oven exhaust or other suitable sources of exhaust air. Main duct 102 can be coupled to adjacent modular duct sections in a suitable manner, such as using existing joining techniques as well as techniques that are specifically adapted for the modular ducts disclosed herein.

Figure 2:
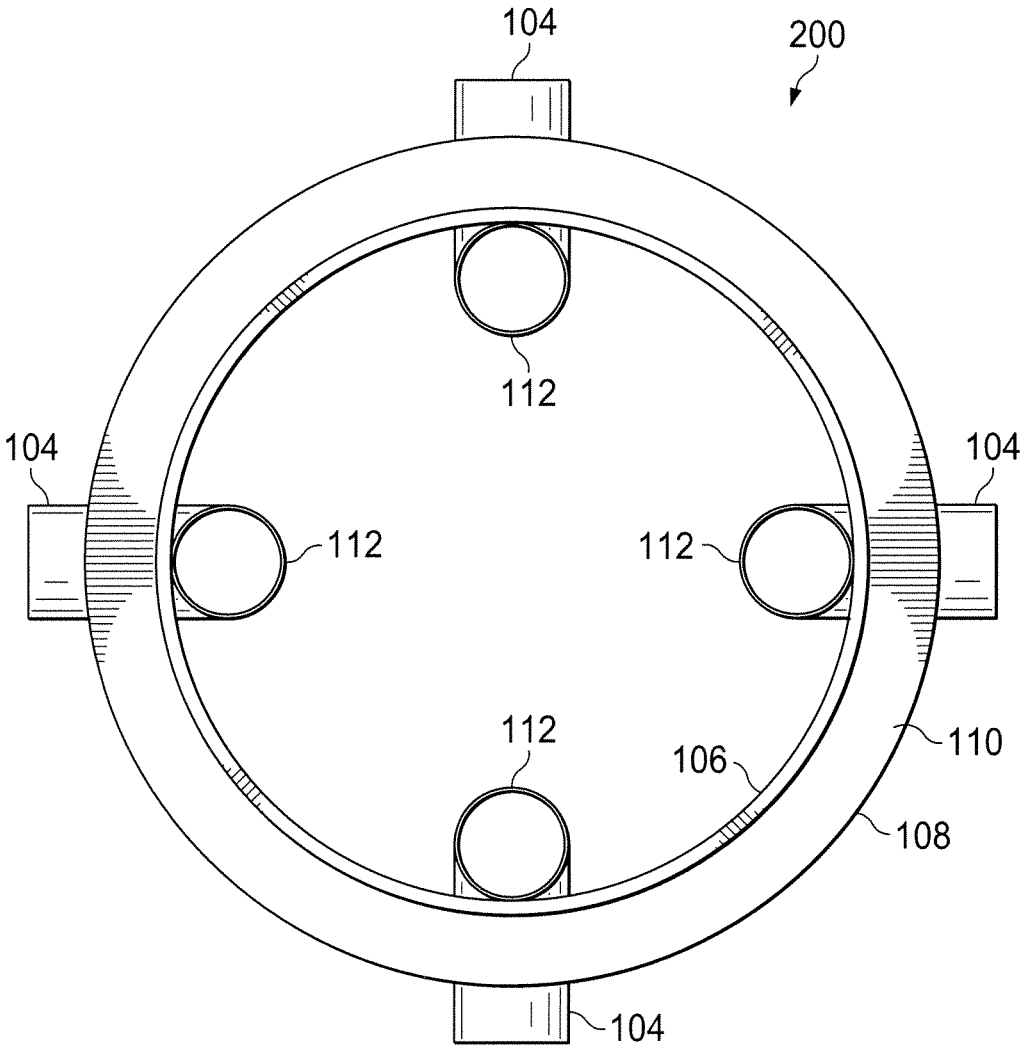
FIG. 2 is an overhead view of a duct assembly with tubular subducts, in accordance with an exemplary embodiment of the present disclosure.

FIG. 2 is an overhead view 200 of a duct assembly with tubular subducts, in accordance with an exemplary embodiment of the present disclosure. Although four horizontal tubular ducts 104 and vertical tubular ducts 112 are shown, a greater or lesser number of horizontal tubular ducts 104 and vertical tubular ducts 112 can alternatively be used, where suitable. Vertical tubular ducts 112 can be coupled to inner wall 106 by rivets, bolts, welding or in other suitable manners.

Figure 3:
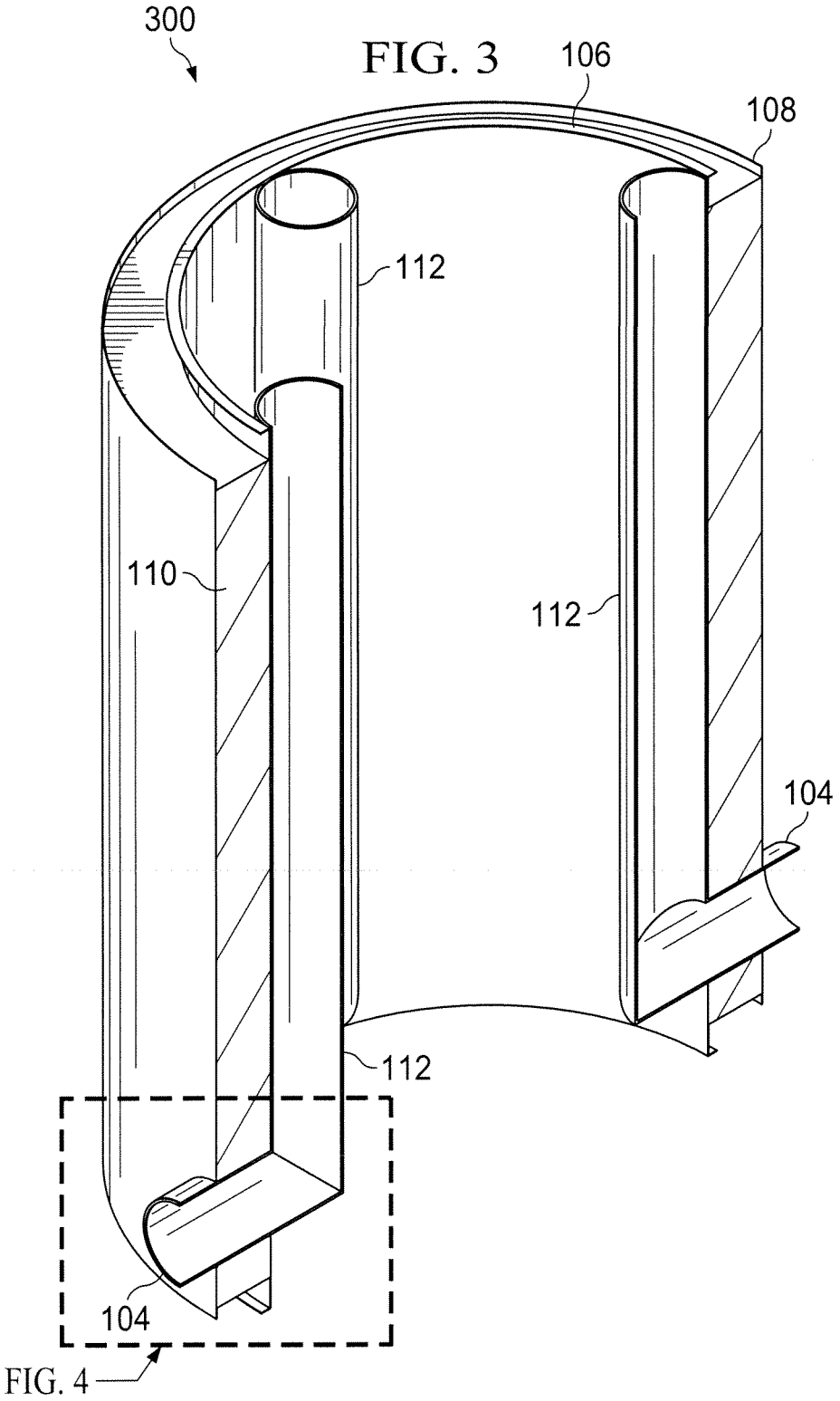
FIG. 3 is a cut-away view of a duct assembly with tubular subducts, in accordance with an exemplary embodiment of the present disclosure.

FIG. 3 is a cut-away view 300 of a duct assembly with tubular subducts, in accordance with an exemplary embodiment of the present disclosure. As shown in cut-away view 300, each horizontal tubular duct 104 extends through outer wall 108, insulating material 110 and inner wall 106, and joins with a vertical tubular duct 112. Each horizontal tubular duct 104 can be soldered to outer wall 108 and inner wall 106, a sealing material or other suitable seal can be provided at the point of contact between each horizontal tubular duct 104 and outer wall 108 and/or inner wall 106, or other suitable materials or configurations can be used.

Figure 4:
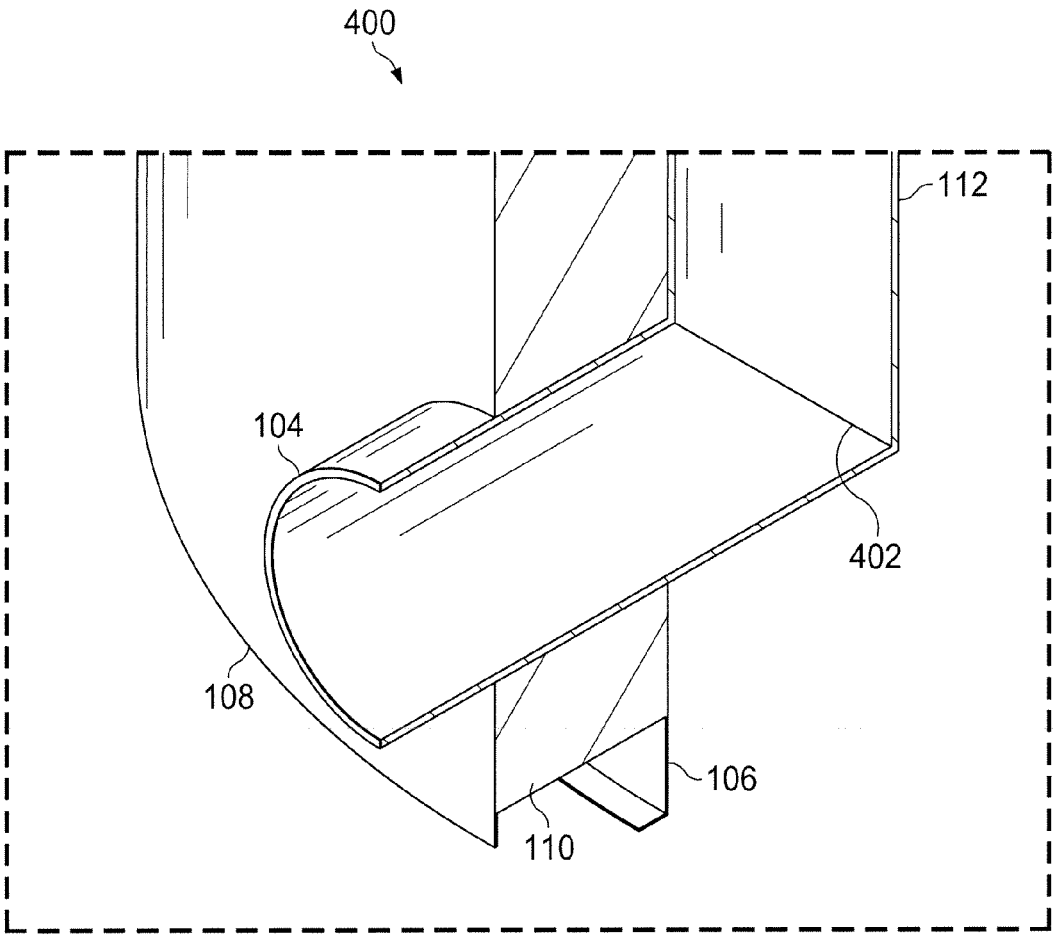
FIG. 4 is a detail view of a tubular subduct assembly, in accordance with an exemplary embodiment of the present disclosure.

FIG. 4 is a detail view 400 of a tubular subduct assembly, in accordance with an exemplary embodiment of the present disclosure. As shown in detail view 400, horizontal tubular duct 104 and vertical tubular duct 112 form a 45 degree mitered joint, such as by welding, bending, riveting or in other suitable manners. In one exemplary embodiment, horizontal tubular duct 104 and vertical tubular duct 112 can be formed from a single run of tubular steel duct, which can be cut to form a centered 90 degree "V" to allow the two ends of the duct to be folded up and welded together. Likewise, other suitable manners of forming a mitered joint with horizontal tubular duct 104 and vertical tubular duct 112 can also or alternatively be used.

Figure 5:
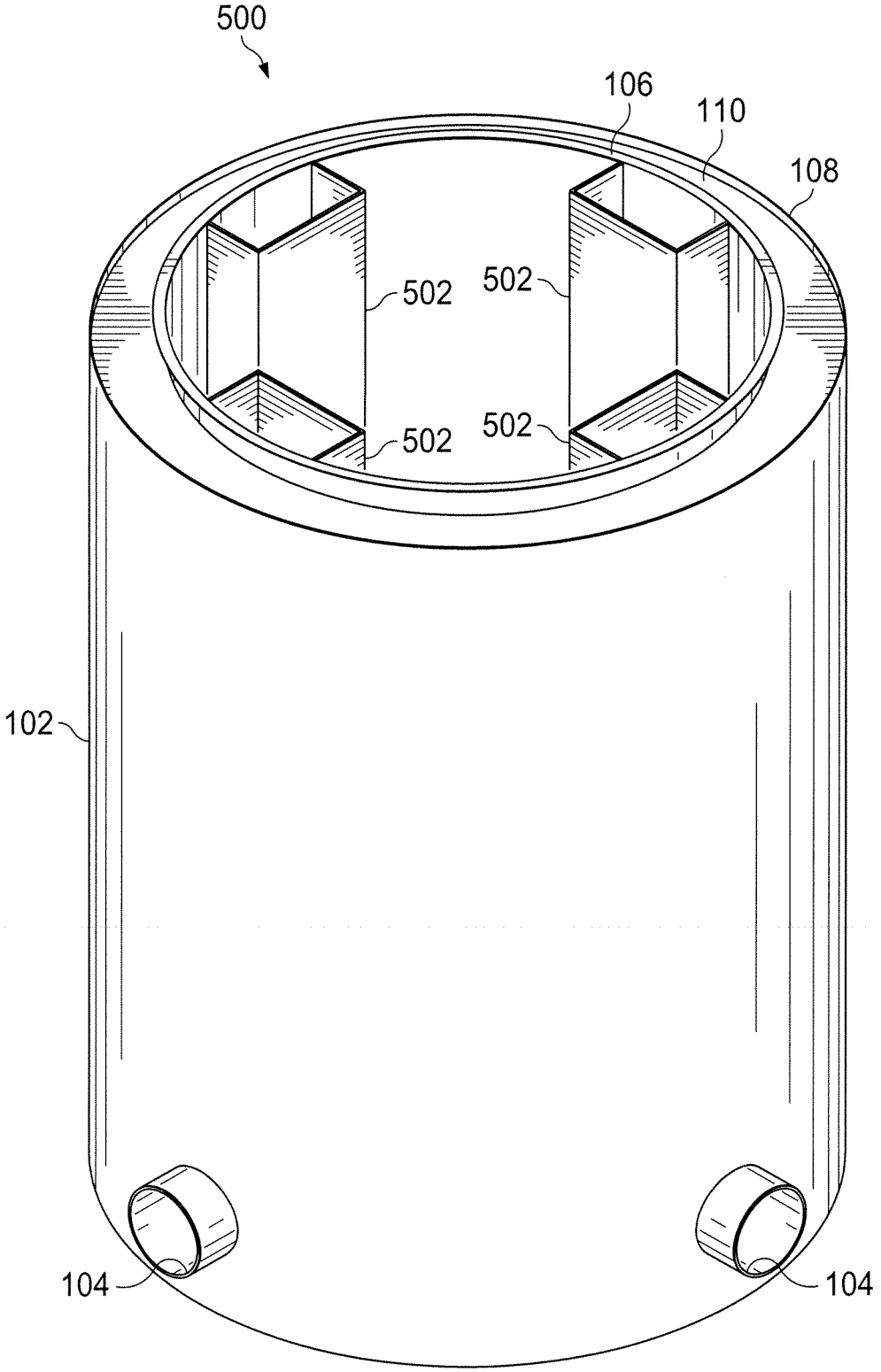
FIG. 5 is a diagram of a duct assembly with rectangular subducts, in accordance with an exemplary embodiment of the present disclosure.

FIG. 5 is a diagram of a duct assembly 500 with rectangular subducts, in accordance with an exemplary embodiment of the present disclosure. Duct assembly 500 includes horizontal tubular ducts 104, which are coupled to vertical rectangular ducts 502. Vertical rectangular ducts 502 are disposed within inner wall 106 of insulated main duct 102, with approximately 90 degrees of separation between each other. Although four horizontal tubular ducts 104 and vertical rectangular ducts 502 are shown, other suitable numbers of horizontal tubular ducts 104 and vertical rectangular ducts 502 could also or alternatively be used, such as one, two that are disposed at approximately 180 degrees from each other, two that are disposed at approximately 90 degrees from each other, three that are disposed at approximately 90 degrees from at least one other or other suitable numbers and dispositions of ducts.

Vertical rectangular ducts 502 can be attached to inner wall 106 by welding, bonding, epoxy, bolts, rivets or in other suitable manners. Although insulated main duct 102 is shown with horizontal tubular ducts 104, it can also be configured with only vertical rectangular ducts 502, such as to form a modular section that can be connected to a lower section with horizontal tubular ducts 104 that are used to connect to an exhaust fan, a clothes dryer exhaust, a warm air oven exhaust or other suitable sources of exhaust air.

Figure 6:
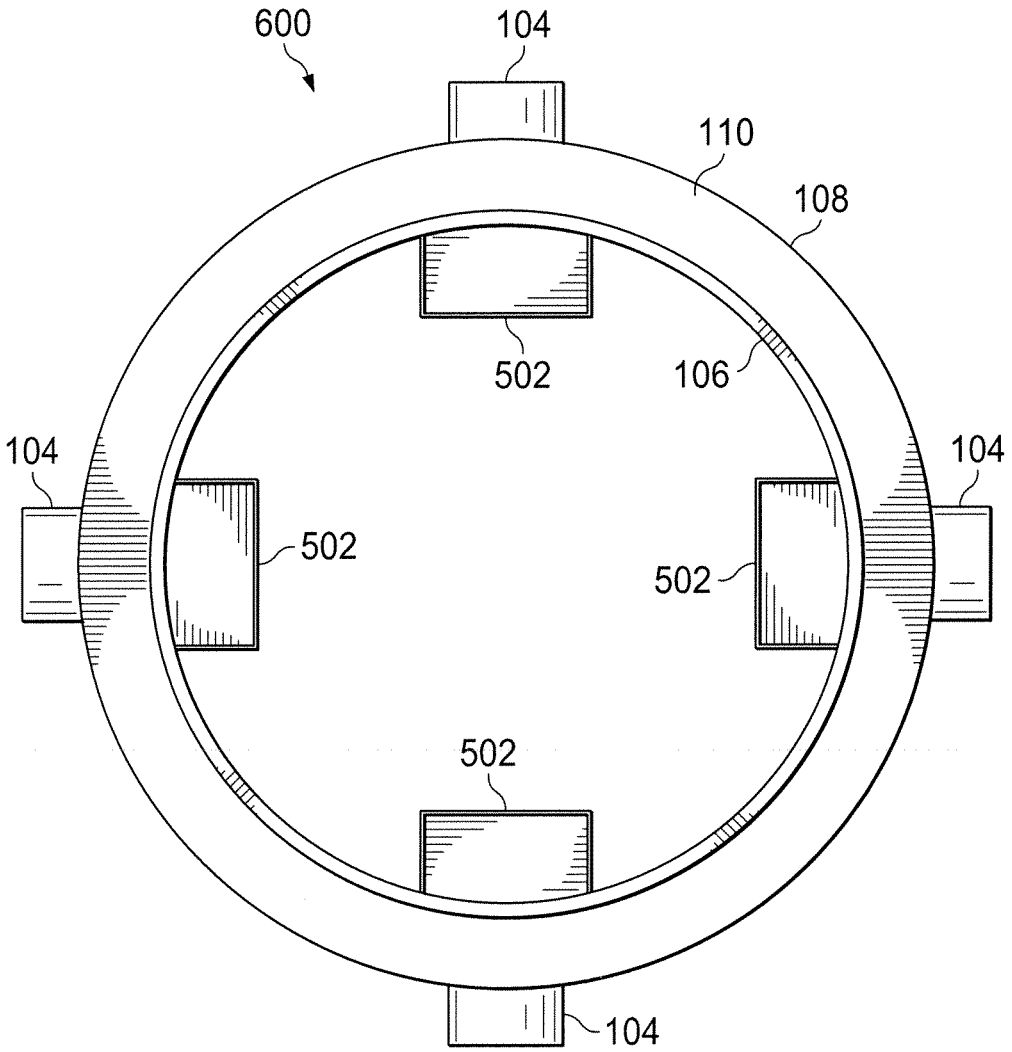
FIG. 6 is an overhead view of a duct assembly with rectangular subducts, in accordance with an exemplary embodiment of the present disclosure.

FIG. 6 is an overhead view 600 of a duct assembly with rectangular subducts, in accordance with an exemplary embodiment of the present disclosure. Although four horizontal tubular ducts 104 and vertical rectangular ducts 502 are shown, a greater or lesser number of horizontal tubular ducts 104 and vertical rectangular ducts 502 can alternatively be used, where suitable. Vertical rectangular ducts 502 can be coupled to inner wall 106 by rivets, bolts, welding or in other suitable manners.

Figure 7:
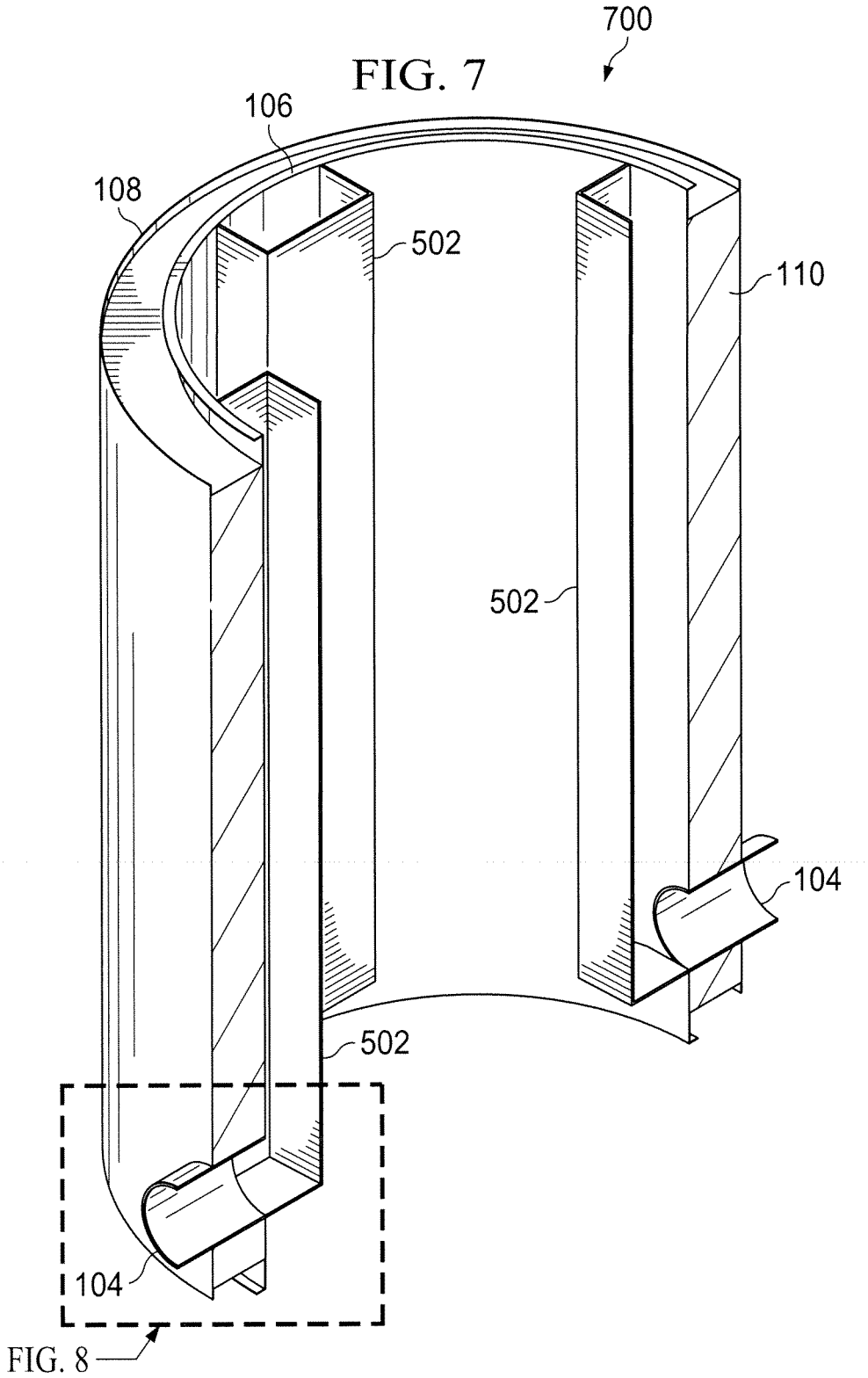
FIG. 7 is a cut-away view of a duct assembly with rectangular subducts, in accordance with an exemplary embodiment of the present disclosure.

FIG. 7 is a cut-away view 700 of a duct assembly with rectangular subducts, in accordance with an exemplary embodiment of the present disclosure. As shown in cut-away view 700, each horizontal tubular duct 104 extends through outer wall 108, insulating material 110 and inner wall 106, and joins with a vertical rectangular duct 502. Each horizontal tubular duct 104 can be soldered to outer wall 108 and inner wall 106, a sealing material or other suitable seal can be provided at the point of contact between each horizontal tubular duct 104 and outer wall 108 and/or inner wall 106, or other suitable materials or configurations can be used.

Figure 8:
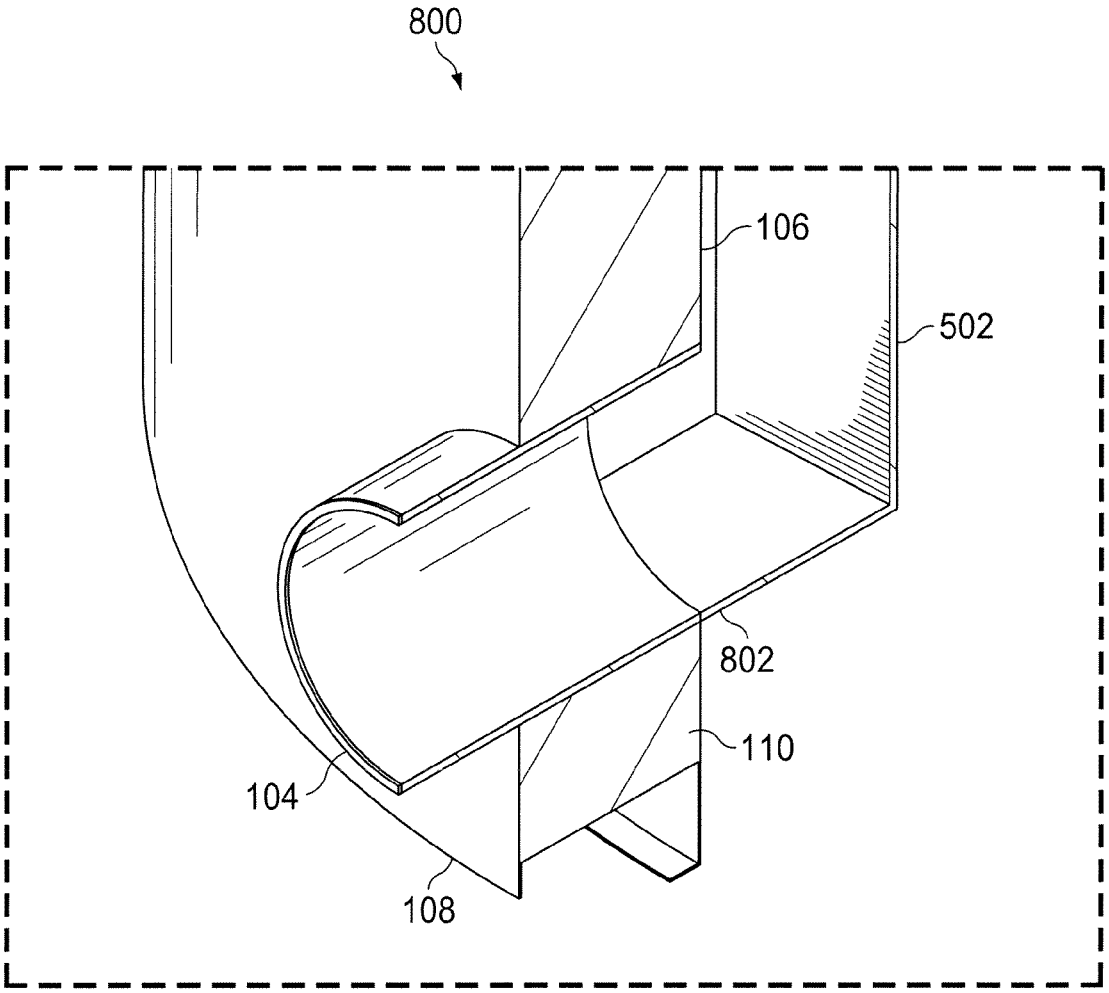
FIG. 8 is a detail view of a rectangular subduct assembly, in accordance with an exemplary embodiment of the present disclosure.

FIG. 8 is a detail view 800 of a rectangular subduct assembly, in accordance with an exemplary embodiment of the present disclosure. As shown in detail view 800, horizontal tubular duct 104 ends at inner wall 106, and vertical rectangular duct 502 is coupled to inner wall 106 by welding, bending, riveting or in other suitable manners. In one exemplary embodiment, each of horizontal tubular ducts 104 can be attached to outer wall 108 and inner wall 106 in a first manufacturing operation, and each of vertical rectangular ducts 502 can be coupled to inner wall 106 in a second manufacturing operation. Likewise, other suitable manners of forming a horizontal tubular duct 104 and vertical rectangular duct 502 can also or alternatively be used.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A duct assembly comprising:

a prefabricated, modular, main duct having an outer wall, an inner wall, a first end and a second end;

a horizontal duct assembly extending through the main duct between the first end and the second end; and a vertical duct assembly extending along the inner wall from the horizontal duct assembly towards the first end.

2. The duct assembly of claim 1 wherein the prefabricated, modular, main duct further comprises an insulation material disposed between the inner wall and the outer wall so as to provide the duct assembly with a fire resistance rating, and an end connector configured to be joined to a second section of the prefabricated, modular main duct.

3. The duct assembly of claim 1 wherein the horizontal duct assembly comprises a tubular duct assembly that is formed from a single run of material with the vertical duct assembly.

4. The duct assembly of claim 1 wherein the vertical duct assembly comprises a tubular duct assembly and is folded from the horizontal duct assembly.

5. The duct assembly of claim 1 wherein the vertical duct assembly comprises a rectangular duct assembly and forms a mitered joint with the horizontal duct assembly.

6. The duct assembly of claim 1 wherein the horizontal duct assembly comprises a first horizontal duct and a second horizontal duct.

7. The duct assembly of claim 1 wherein the vertical duct assembly comprises a first vertical duct and a second vertical duct.

8. The duct assembly of claim 1 wherein the main duct comprises a circular duct.

9. The duct assembly of claim 8 wherein the horizontal duct assembly comprises a first tubular horizontal duct and a second tubular horizontal duct disposed 90 degrees from the first tubular horizontal duct around an inner circumference of the main duct.

10. The duct assembly of claim 9 wherein the vertical duct assembly comprises:

a first tubular vertical duct forming a 45 degree mitered joint with the first tubular horizontal duct from a first single run of tubular steel duct; and a second tubular vertical duct forming a 45 degree mitered joint with the second tubular horizontal duct from a second single run of tubular steel duct.

11. A method of forming a duct assembly comprising:

forming a main duct having an outer wall, an inner wall, a first end and a second end;

forming a horizontal duct assembly extending through the main duct between the first end and the second end; and forming a vertical duct assembly extending along the inner wall from the horizontal duct assembly towards the first end.

12. The method of claim 11 wherein forming the main duct further comprises disposing an insulation material between the inner wall and the outer wall.

13. The method of claim 11 wherein forming the horizontal duct assembly comprises inserting a tubular duct assembly through the main duct and sealing the horizontal duct to the outer wall of the main duct and the inner wall of the main duct.

14. The method of claim 11 wherein forming the vertical duct assembly comprises attaching a tubular duct assembly to the inner wall and forming the vertical duct assembly from a single run of tubular duct steel with the horizontal duct assembly.

15. The method of claim 11 wherein forming the vertical duct assembly comprises attaching a rectangular duct assembly to the inner wall.

16. The method of claim 11 wherein forming the horizontal duct assembly comprises inserting a first horizontal duct and a second horizontal duct through the main duct and sealing the first horizontal duct and the second horizontal duct to the outer wall and the inner wall of the main duct.

17. The method of claim 11 wherein forming the horizontal duct assembly comprises:

inserting a first tubular horizontal duct through the outer wall and the inner wall;

cutting the first tubular horizontal duct to form a centered 90 degree "V";

folding the centered 90 degree "V" to form a first tubular vertical duct; and inserting a second tubular horizontal duct through the other wall and the inner wall at a location 90 degrees from the first tubular horizontal duct around an inner circumference of the main duct.

18. The method of claim 17 wherein forming the vertical duct assembly comprises:

folding a first tubular vertical duct from a first single run of tubular steel used to form the first tubular horizontal duct to form a first 45 degree mitered joint; and folding a second tubular vertical duct from a second single run of tubular steel used to form the second tubular horizontal duct to form a second 45 degree mitered joint.

19. A method of forming a duct assembly comprising:

forming a main duct having an outer wall, an inner wall, a first end and a second end by forming a first hole in the inner wall, forming a second hole in the outer wall, bending the inner wall around a mandrel, bending the outer wall around the mandrel and aligning the first hole and the second hole;

forming a horizontal duct assembly extending through the main duct between the first hole and the second hole; and forming a vertical duct assembly extending along the inner wall from the horizontal duct assembly towards the first end.

20. The method of claim 19 wherein forming the vertical duct assembly comprises:

cutting a single run of tubular duct steel to form the first tubular horizontal duct;

cutting the single run of tubular duct steel to form a centered 90 degree "V"; and folding the centered 90 degree "V" to form the vertical duct assembly.

* * * * *